United States Patent [19]

Hohenstein

[11] 4,126,166

[45] Nov. 21, 1978

[54] SECURING APPARATUS FOR GOLF HEAD COVERS

[76] Inventor: George Hohenstein, 44 Meditation Way, Saratoga Springs, N.Y. 12866

[21] Appl. No.: 823,410

[22] Filed: Aug. 10, 1977

[51] Int. Cl.[2] ..... A63B 55/00; A63B 57/00

[52] U.S. Cl. ..... 150/1.5 R; 150/52 G; D34/5 GB

[58] Field of Search ..... 150/1.5, 52 G; 248/499, 248/500, 96; 273/32 E, 32 R; D34/5 CB, 5 GH, 5 GB

[56] References Cited

U.S. PATENT DOCUMENTS

| | | | |
|---|---|---|---|
| 1,957,577 | 5/1934 | Chapman | 150/1.5 R |
| 2,563,698 | 8/1951 | Whitebread | 248/499 |
| 2,633,173 | 3/1953 | Reed | 150/1.5 R |
| 3,015,351 | 1/1962 | Harris | 150/52 G |
| 3,128,812 | 4/1964 | Scheurer | 150/1.5 R |
| 3,460,207 | 8/1969 | Stewart | 150/52 G |
| 3,747,654 | 7/1973 | Wilson | 150/1.5 R |
| 3,985,171 | 10/1976 | Summers | 150/1.5 R |

FOREIGN PATENT DOCUMENTS

| | | | |
|---|---|---|---|
| 940,885 | 1/1974 | Canada | 150/1.5 R |
| 859,116 | 1/1961 | United Kingdom | 150/1.5 R |

*Primary Examiner*—Herbert F. Ross

[57] ABSTRACT

Apparatus for protectively securing golf head covers to a golf bag to prevent loss or damage of head covers is disclosed. A plurality of grommets are disposed in uniform spaced relation about the upper periphery of a golf bag. A like plurality of flexible members has first ends thereof attached to a corresponding grommet, and second ends thereof attached to the ring means commonly on the upper surfaces of golf head covers.

In two embodiments of this invention the grommets are disposed along a strap member adapted to be attached to a golf bag at the divider strap attachment point commonly provided on golf bags. In one of these, the strap member is provided with clips or snap fasteners for attachment to the portion of the club divider strap located on the exterior surface of the golf bag; in the other, the strap member of this invention is passed through the club divider strap grommets and its ends are connected to encircle the portion of the peripheral surface of the golf bag between the club divider strap grommets. In other embodiments of this invention the flexible members are attached to grommets disposed directly through the golf bag itself, or to grommets disposed through the club divider strap within the golf bag.

10 Claims, 6 Drawing Figures

SECURING APPARATUS FOR GOLF HEAD COVERS

This invention relates to securing means for golf head covers. More particularly, this invention relates to securing means for golf head covers in which each head cover is secured independently of the other head covers.

As is well known in the art, golf woods, that is golf clubs having wooden heads, require for their preservation, protection against nicking, scratching, abrasion, and other damage when in transport, or otherwise not in use. Accordingly, devices known as head covers, and commonly fabricated of leather, plastic, or woven or knitted cloth have been provided to protectively, and removably, surround the head portion of golf woods. When the wood is to be played, the head cover is removed. Golfers have experienced inconvenience in removing head covers in that when the cover is removed for the club to be played, they must individually handle the club and its cover. This has been frequently found to result in head covers being dropped or otherwise misplaced, in turn resulting in the covers becoming lost, soiled, or otherwise damaged.

In the commonly employed attempt of the prior art to alleviate the above described difficulties inherent in a free head cover, head covers are almost universally provided with ring means attached to the upper surfaces of the covers. A flexible member such as a cord or thong is used to interconnect the ring members attached to the various head covers so that when the cover is removed from the head of the club to be played, the removed cover is retained in position in the golf bag by its attachment to the covers of the clubs remaining in the bag. It has been found, however, that head covers retained in this manner tend, long before a round of golf can be completed, to become so twisted and inter-tangled among each other and with the thong or other flexible member inter-connecting them, that the solution quickly becomes more annoying than the problem which it was intended to solve.

Because of the above-described difficulties, the prior art has developed a number of alternative head cover retaining means. Many of these require modification of standard head covers, as, for example by requiring relocation of the ring means from the upper portion of the head cover to a non-standard location, the provision of a quantity of material commonly known by the trade name VELCRO on head covers and on the golf bag, the provision of individual cords connected between each head cover and a like plurality of mechanical retracting means, and thongs having divided ends so that individual head covers may be attached to a corresponding division of the thong individually. The prior art solutions have not achieved widespread acceptance, probably because the proposed solutions suffer from the following disadvantages, singly or in combination: high expense and complexity, insufficiently secure retention of head covers, requiring specially constructed head covers so as to not be useable with the head covers already owned by a golfer, and undesirable restriction of position of clubs within a golf bag.

It is accordingly an object of this invention to provide tangle resistant head cover securing apparatus for golf club head covers.

It is another object of this invention to provide such apparatus in a form which does not restrict the ability of a golfer to position and retain clubs within a golf bag as he may desire.

A further object of this invention is to provide such apparatus which is adapted to be used for securing head covers of currently standard configuration.

Yet another object of this invention is to provide such head cover securing apparatus which is very simple and inexpensive to manufacture and which is adapted to be easily installed on golf bags of current manufacture.

It is also an object of this invention, in one embodiment thereof, to provide for the simple and inexpensive incorporation of head cover securing apparatus in a golf bag at the time of the original manufacture of the bag.

Briefly, and in accordance with one embodiment of this invention, a strap member has a plurality of fastening means disposed along the length thereof in substantially evenly spaced relation. The strap member is provided, at opposite ends thereof, with means for attaching the strap member about the upper outer periphery of a golf bag to protruberences commonly found on golf bags of current manufacture. Each of a plurality of flexible members having first and second ends are securely attached at a first end to a corresponding one of the plurality of the attachment means spaced along the strap member. The second end of each of the flexible members is securely attached to the extension means such as ring means or tassel means located on the upper surface of a golf club head cover. In another embodiment of this invention the attachment means are installed in spaced relation directly about the upper periphery of a golf bag.

The novel features of this invention sought to be patented are set forth with particularity in the appended claims. The invention, together with further objects and advantages thereof may be understood from a reading of the following specification and appended claims in view of the accompanying drawings, in which:

Figure 1:
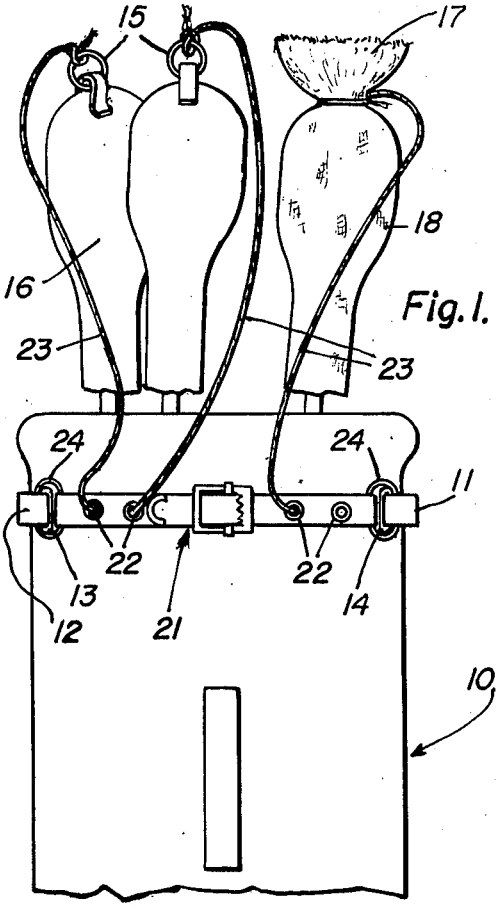
FIG. 1 is a side elevation view of a golf bag configured in accordance with current manufacture having head cover retaining apparatus in accordance with one embodiment of this invention installed thereon.

In FIG. 1, a golf bag, indicated generally at 10, is equipped with a club divider strap as is known in the art. In accordance with standard current manufacturing practice, the club divider strap is removably secured within bag 10 by straps 11 and 12 which penetrate bag 10 at grommets 13 and 14. The penetration of bag 10 by straps 11 and 12 at grommets 13 and 14 provides a convenient means for attachment of the strap member, indicated generally at 21, of the head cover securing apparatus of this invention to bag 10. The head cover securing apparatus in accordance with this invention comprises strap 21 which is adapted to be attached about the upper periphery of a golf bag, and which may be formed of leather, nylon mesh, elastic, or other suitable material, and which has inserted therein, at substantially evenly spaced intervals along the length thereof, a plurality of fastening means 22, which may be grommets inserted through strap member 21, snap fasteners, or other equivalent appropriate fastening means. The apparatus of this invention further includes a plurality of flexible members, 23 which may be woven cords of nylon or other material, or leather thongs, or equivalent. A first end of each of flexible members 23 is secured to a corresponding one of attachment means 22 in strap 21. For example, if attachment means 22 comprise grommets, flexible members 23 may be secured by simply knotting the end of members 23 behind strap 21 so that a knob of the material of member 23 is formed having a diameter too large to pass through the grommet. If attachment means 22 comprise snap or other type fasteners, the first ends of members 23 are provided with an appropriate mating component. The second ends of members 23 are each securely attached to an individual one of extension means such as ring means 15 attached to the upper surface of their associated head covers 16, or tassels 17 atop knitted head covers 18. As mentioned hereinabove, head covers 16 and ring means 15 are standard prior art head cover construction for covers of other than knitted construction and do not in and of themselves form a part of this invention. Similarly, the construction of knitted head covers 18 having tassels 17, is known in the art and does not form part of this invention. The attachment of flexible members 23 to ring means 15 or tassels 17, may simply and conveniently be by tying the end of each flexible member 23 to its associated head cover ring means 15. Tying produces a quasi permanent attachment, but this is deemed desirable. Alternatively, the second ends of flexible members 23 may be provided with spring clip members for quickly detachably connecting them to ring means 15 without departing from the scope of this invention. However, this alternative is considered unnecessarily expensive, particularly in view of the facts that detachment of head covers from the securing apparatus would rarely be desirable, and the strap member 21 as employed in several embodiments of this invention, is itself readily detachable.

Figure 2:
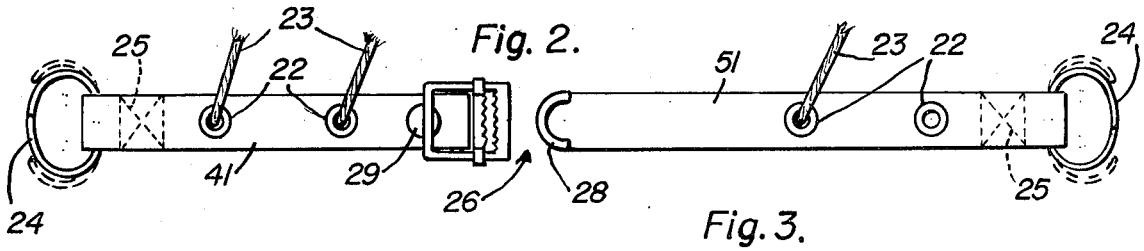
FIG. 2 is a detailed plan view of the strap member of apparatus in accordance with this invention, with the various attachment means thereon, conforming to the embodiment illustrated in FIG. 1.

FIG. 2 provides a detailed illustration of one embodiment of strap member 21 of FIG. 1, which, when viewed in conjunction with FIG. 1 clarifies a significant feature of one embodiment of this invention. As any golfer will readily realize, the arcuate distance between club divider strap grommets 13 and 14 varies among golf bags 10 as different models and manufactures of bags are considered. Accordingly, in order to achieve the object of this invention to provide head cover securing apparatus useable with golf bags and head covers of current manufacture, at a reasonable cost, it is desired to provide an embodiment of this invention which is useable on a variety of makes and models of golf bags without the necessity for redesign of the apparatus of this invention. A strap member having this desired commonality of application is shown in FIG. 2, and comprises first and second strap segments 41 and 51, having attachment means 24 for attaching strap 21 between club divider straps 11 and 12 at first end of each of segment 41 and 51, and joining means indicated generally at 26 at the opposite second ends of each of segments 41 and 51 to connect segments 41 and 51 together to form strap 21 with variable length.

Figure 3:
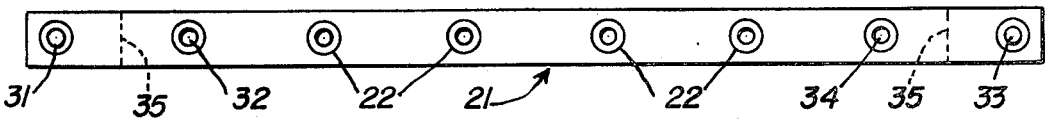
FIG. 3 is a plan view of a strap member in accordance with a modified embodiment of this invention.

Attachment means 24 may conveniently comprise clip rings of the type commonly used for binding sheets of loose leaf paper. Members 24 are conveniently attachable to the ends of segments 41 and 51 by wrapping a portion of the strap material about the attachment means and securing the attachment means in the loop thus formed by stiching as indicated at 25. An alternative to clip ring attachment means 24 is illustrated in FIG. 3. Two pairs of snap fasteners 31 and 32, and 33 and 34, respectively, are attached to opposite ends of strap member 21 in spaced relation to each other. The ends of strap 21 may be inserted under club divider straps 11 and 12, and strap member 21 folded over about straps 11 and 12 along line 35 of FIG. 3, and snap fasteners 31 and 32, and 33 and 34, connected to provide an attaching loop.

Returning to FIG. 2, joining means 26 may comprise a luggage type web buckle assembly comprising buckle member 27 attached to the end of strap segment 41 opposite attachment means 24, and guide member 28 attached to the end of strap segment 51 opposite the attachment means. Buckle 27 may be conveniently attached to segment 41 by forming a loop in the end of strap 41 and securing the loop by rivet 29, or by stiching. The use of a luggage type buckle is most convenient when strap member 21 is constructed of nylon web, or equivalent material. Alternative joining means will occur to those skilled in the art. For example, opposing surfaces of segments 41 and 51 may be provided with hook and loop fastening material such as that commonly known by the trade name VELCRO. The choice of a preferred fastener is a matter of design choice which may be made by those skilled in the art without departing from the scope of this invention, and will vary depending upon the selection of the material comprising strap 21. The only requirement of this invention is that joining means 26 provide for the secure joining of segment 41 and 51 into strap 21 in such manner as to provide for overall adjustability of length of strap 21.

FIG. 3 illustrates an alternative embodiment of strap member 21 in which length adjustment joining means or connecting a plurality of segments comprising strap 21. In the embodiment of FIG. 3, strap 21 is formed of an elastic material having a plurality of grommets 22 inserted therethrough in substantially uniform spaced relation, and further having a pair of mating snap fasteners 31 and 32 at a first end thereof for attachment of said first end to strap 21, and another pair of mating snap fasteners 33 and 34 at second end thereof for attachment of strap member 21 to strap 11, as discussed hereinabove.

Figure 6:
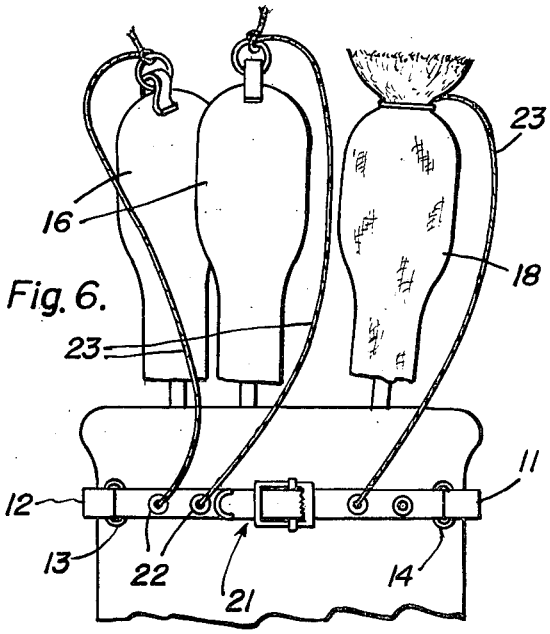
FIG. 6 is a side elevation view of the golf bag of FIG. 1 having head cover retaining apparatus in accordance with a modified embodiment of this invention installed thereon.

FIG. 6 illustrates another alternative embodiment of this invention in which club divider strap grommets 13 and 14 are enlarged, if necessary, to be able to have passed therethrough a single, unitary, strap member 21 in accordance with this invention, as well as the club divider straps. In this embodiment, strap 21 passes through the golf bag between grommets 13 and 14 and is thereby retained in position alternatively to attachment by means 24 as discussed hereinabove. Otherwise, this embodiment is essentially identical to that discussed above with reference to FIG. 1. Strap member 21 is provided with attachment means for the flexible members, and also has joining means for connecting the ends of the strap securely about the outer periphery of the golf bag.

Figure 4:
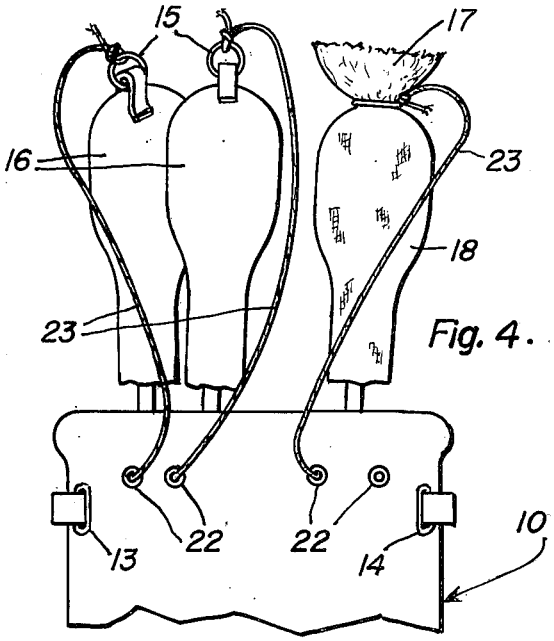
FIG. 4 is a side elevation view of head cover securing apparatus in accordance with another embodiment of this invention in which a portion of a golf bag is included as a component of the apparatus of this invention.

FIG. 4 illustrates an embodiment of this invention in which a portion of the apparatus of this invention comprises a modification to the golf bag itself at the time of its manufacture. In accordance with this embodiment, a plurality of grommets 22, or equivalent means such as rings, snaps, or hooks, are installed in substantially uniform spaced relation about a peripheral surface of the golf bag proximately the upper lip thereof. Flexible members 23 are secured to said grommets or equivalent means at a first end thereof, and are attached to head cover ring means 15 at second ends thereof, as heretofore described.

Figure 5:
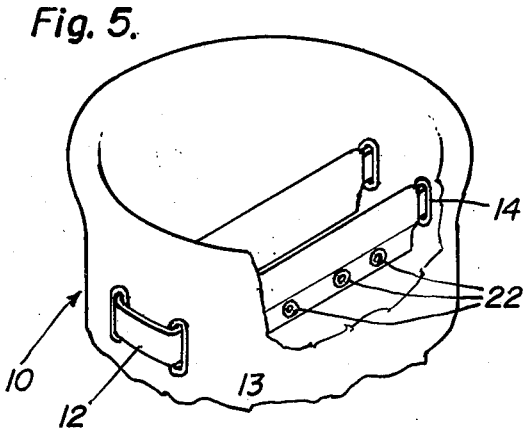
FIG. 5 is a perspective view of a golf bag in which the club divider strap of the golf bag is incorporated as a component of the apparatus of this invention.

FIG. 5 illustrates another embodiment of this invention in which the grommet, ring, clip, or other equivalent means for securing said first ends of said flexible members 23 are attached to the club divider strap within the golf bag. Similarly to the embodiment of FIG. 4, this embodiment is adapted to be incorporated in a golf bag at the time of its manufacture. Except for the placement of the grommets or equivalent means, this embodiment is essentially identical to that described with reference to FIG. 4, and thus need not be discribed in further detail here.

It may thus be seen that apparatus in accordance with this invention provides for securing of golf head covers to protect them from loss or damage with minimal likelihood of annoying entanglement among head covers or their securing means, and, as a result of the individual attachment of each head cover to a point in spaced-apart relation to the attachment points for other head covers, provides minimal restrictions upon the golfer's freedom to position his clubs within his golf bag as he may choose. Additionally, the apparatus of this invention may be seen to be readily adaptable to bags and head covers of current manufacture.

While this invention has been described with reference to particular embodiments and examples, other modifications and variations will occur to those skilled in the art, in view of the above teachings. Accordingly, it should be understood that within the scope of the appended claims, the invention may be practiced otherwise than is specifically described.

The invention claimed is:

1. Apparatus for protectively securing golf head covers having extension ring means atop said covers comprising:

at least two separate flexible members having first and second ends;

a strap having a plurality of means disposed in substantially uniform spaced relation for receiving and securing said first ends to said strap on a golf bag, one and only one of said first ends being attached to each of said plurality of means and positionally restricting said first end;

the remainder of each of said flexible members being positionally unrestricted by said means for securing; and means for attaching each of said second ends to a corresponding one of said extension means atop said covers.

2. Apparatus as claimed in claim 1 wherein said means for attaching said second ends is a knot tied in said second end about said corresponding extension means.

3. Apparatus as claimed in claim 1 including means attached to said strap member for attaching said strap member between two elements of a club divider strap on a surface of a golf bag.

4. The apparatus of claim 3 wherein said plurality of means disposed along said strap member are grommets inserted through said strap member.

5. The apparatus of claim 3 wherein said strap member more particularly comprises:

first and second strap segments, each said segment having means for attaching to one of said two elements of a club divider strap; and means for joining said first and second segments to form said strap member so that said strap member has an overall length equal to the arcuate distance around said golf bag between said two elements of a club divider strap.

6. The apparatus of claim 5 wherein:

said strap segments are strips of nylon web material; and said means for joining is a web buckle.

7. Apparatus as claimed in claim 1 wherein said strap member is adapted to be passed through a golf bag between a pair of club divider strap grommets penetrating a surface of said golf bag, and having means for connecting opposite ends of said strap member together to secure a portion of said strap member about said surface of said golf bag between said club divider grommets.

8. In combination with a golf bag and golf head covers, said golf head covers having extension ring means atop said covers, apparatus for protectively securing said golf head covers to said golf bag comprising:

at least two separate flexible members having first and second ends;

a plurality of means disposed in substantially uniform spaced relation adjacent the open end of said bag for receiving and securing said first ends to said golf bag, one and only one of said first ends being attached to each of said plurality of means and positionally restricting said first end;

the remainder of each of said flexible members being positionally unrestricted by said means for securing; and means for attaching each of said second ends to a corresponding one of said extension means atop said covers.

9. In combination with a golf bag and golf head covers, said golf bag having club divider straps extending across the open end of said bag, said head covers having extension ring means atop said covers, apparatus for protectively securing said golf head covers to said golf bag comprising:

at least two separate flexible members having first and second ends;

a plurality of means disposed along one of said divider straps in substantially uniform spaced relation for receiving and securing said first ends to said golf bag, one and only one of said first ends being attached to each of said plurality of means and positionally restricting said first end;

the remainder of each of said flexible members being positionally unrestricted by said means for securing; and means for attaching each of said second ends to a corresponding one of said extension means atop said covers.

10. The apparatus of claim 9 wherein said plurality of means are grommets inserted through said club divider strap.

* * * * *